US007308770B2

(12) United States Patent
Fast et al.

(10) Patent No.: US 7,308,770 B2
(45) Date of Patent: Dec. 18, 2007

(54) ELECTRONIC SHELF LABEL HOLDER FOR SCANNER PLATE AND WIRE SUPPORTS

(75) Inventors: Jacob Fast, Boca Raton, FL (US); Michael G. Lowry, The Woodlands, TX (US)

(73) Assignee: Fast Industries, Ltd, Fort Lauderdale, FL (US)

( * ) Notice: Subject to any disclaimer, the term of this patent is extended or adjusted under 35 U.S.C. 154(b) by 218 days.

(21) Appl. No.: 11/264,754

(22) Filed: Nov. 2, 2005

(65) Prior Publication Data

US 2006/0117627 A1 Jun. 8, 2006

Related U.S. Application Data

(60) Provisional application No. 60/623,865, filed on Nov. 2, 2004.

(51) Int. Cl.
*G09F 3/00* (2006.01)

(52) U.S. Cl. ..... 40/642.01; 40/642.02; 40/308; 40/661.03

(58) Field of Classification Search ..... 40/642.02, 40/661.03, 642.01, 308
See application file for complete search history.

(56) References Cited

U.S. PATENT DOCUMENTS

| | | | | |
|---|---|---|---|---|
| 6,035,569 | A * | 3/2000 | Nagel et al. | 40/661.03 |
| 6,069,596 | A * | 5/2000 | Marvin et al. | 40/649 |
| 6,119,990 | A * | 9/2000 | Kump et al. | 40/661.03 |
| 6,189,248 | B1 * | 2/2001 | Nagel et al. | 40/661.03 |
| 6,622,410 | B2 * | 9/2003 | Wilkes et al. | 40/661.03 |
| 2003/0111580 | A1 * | 6/2003 | Catteau et al. | 40/661.03 |

* cited by examiner

*Primary Examiner*—Gary C. Hoge
(74) *Attorney, Agent, or Firm*—Jacobson Holman PLLC

(57) ABSTRACT

An electronic shelf label holder for mounting to both scanner plates and wire merchandise supports, such as wire racks or baskets, that are used in connection with retail merchandising. The label holder includes a holding portion for holding an ESL and a mounting portion that can be utilized for mounting to both scanner plates and wire racks. When mounted to scanner plates, the label holder can be oriented in different directions.

11 Claims, 3 Drawing Sheets

ELECTRONIC SHELF LABEL HOLDER FOR SCANNER PLATE AND WIRE SUPPORTS

This application claims the benefit of, and priority from, provisional application Ser. No. 60/623,865 filed Nov. 2, 2004.

BACKGROUND OF THE INVENTION

1. Field of the Invention

This invention relates to label holders, particularly an electronic shelf label (ESL) holder capable of mounting to both scanner plates and wire merchandise supports, such as wire racks or baskets, used in connection with retail merchandising. The ESL holder is mountable to the scanner plate in different orientations.

2. Description of the Related Art

Electronic shelf labels are increasingly utilized in retail establishments in place of, or in addition to, paper and plastic information-carrying labels. These ESLs are generally integrated with an in-store processor or a free-standing controller that communicates with file information supporting the store's point of sale system. The ESL system may include low voltage communication electronics or communication base stations located in store ceilings away from the store operations. The ESLs are positioned throughout the store to identify an item's retail price and other information of interest to the consumer and/or for use by the store's inventory system. Price changes can be initiated through the controller to update item price files.

Electronic shelf labels, attachable to ESL holders which, in turn, are attachable to the front edge of store shelving are known. As described in commonly-assigned, pending application Ser. No. 10/448,049 filed on May 30, 2003, published on Dec. 30, 2004 under Publication No. 20040262470, an ESL such as those produced by NCR under its DecisioNet™ trademark are shown mounted to shelving, including C-channels. Among the embodiments disclosed includes an ESL holder member that engages with an attachment member which in turn is connected to the shelving or C-channel thereof. The attachment member includes a multiplicity of T-shaped protrusions and the holder includes a plurality of fingers that define gaps that are either snapped over or slid about the T-shaped protrusions. Thus, the holder can be positioned at different angular orientations with respect to the attachment member.

In U.S. Pat. No. 6,119,990 issued Sep. 19, 2000, an electronic shelf label holder is described to include an adaptor where the holder is connected with the adaptor in different locations through a separate fastener element.

Fixed angle ESL holders are described in commonly-assigned, pending application Ser. No. 60/616,845 filed on Oct. 8, 2004, and non-provisional patent application Ser. No. 11/245,441 filed Oct. 7, 2005, incorporated by reference herein. There, the ESL is retained to the holder by a flexible PVC bead on the holder wall which engages the back of the ESL and a downwardly-oriented flexible lip that engages the ESL.

The ESL holders described above are attachable to shelf components such as the C-channels or directly to the front edge of the shelving. However, a need has arisen for using ESLs outside the context of direct connection to shelving components. In commonly-assigned co-pending application Ser. No. 10/959,436 filed Oct. 7, 2004, published Apr. 14, 2005 under Publication No. US 2005/0076554 A1, a label holder, including an ESL holder, is provided for mounting on a supporting surface formed of wire, such as a wire basket, a wire rack, a wire shelf, or the like.

Each of the ESL holders described above is intended for use with a single type of mounting surface, either a channel or a wire basket, but not both. A need has arisen for ESL holders that can be mounted to various merchandise display configurations.

One common merchandise display is a scanner plate arrangement that is commonly found in supermarkets, pharmacies and the like, and is often carried by an apertured board or other supporting surface. Generally, these scanner plate or hook assemblies comprise a pair of interconnected, vertically-spaced, horizontally extending hooks or elements cantilevered forwarded from a proximal mounting portion. The distal end of the upper hook may have a right-angled cross bar to which a flat scanner plate is welded thereto. The flat scanner plate is adapted to carry a label, typically of paper, or a label holder. The lower hook may be a single forwardly-extending element for slidably receiving a plurality of products, such as plastic encased products with an aperture or slot. With the advent of electronic shelf labels, a need has arisen for the scanner plate assemblies to support such an electronic shelf label.

SUMMARY OF THE INVENTION

It is a primary object of the present invention to provide a highly versatile label holder, particularly an ESL holder, adapted for affixing to wire supporting surfaces, such as baskets, racks, or shelves.

It is further an object of the present invention to provide a label holder, particularly an ESL holder, that is mountable to a scanner plate.

It is still further an object of the present invention to provide a single holder, such as an ESL holder, that is capable of mounting to both a scanner plate and a wire support structure, such as a wire basket, thus eliminating the need for separate dedicated holders for different merchandise display arrangements.

Still further, it is an object of the present invention to provide an ESL holder that is mountable to a scanner plate in different orientations to direct the label holder upwardly, downwardly, or neutrally, i.e., straightforward, depending upon the position of the wire hook to which the scanner plate is attached.

Other and further objects, features, and advantages of the invention will become apparent from the ensuing description and claims taken in conjunction with the attached drawings.

BRIEF DESCRIPTION OF THE DRAWINGS

These and other objects, features and many of the attendant advantages of this invention will be better understood by those of ordinary skill in the art in connection with the following detailed description of the preferred embodiments and the accompanying drawings wherein.

Like reference characters refer to like parts throughout the several views of the drawings.

DESCRIPTION OF THE PREFERRED EMBODIMENTS

Figure 1:
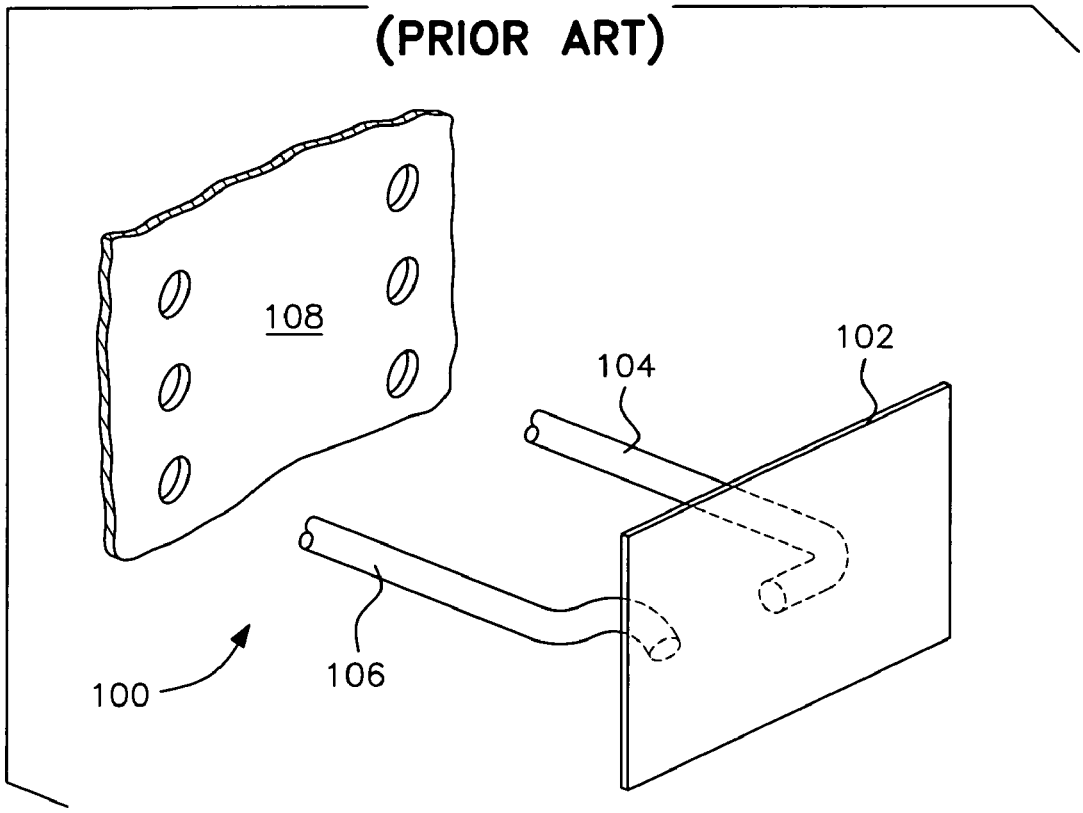
FIG. 1 (PRIOR ART)
FIG. 1 depicts a merchandise display hook arrangement with a scanner plate as is known in the art.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
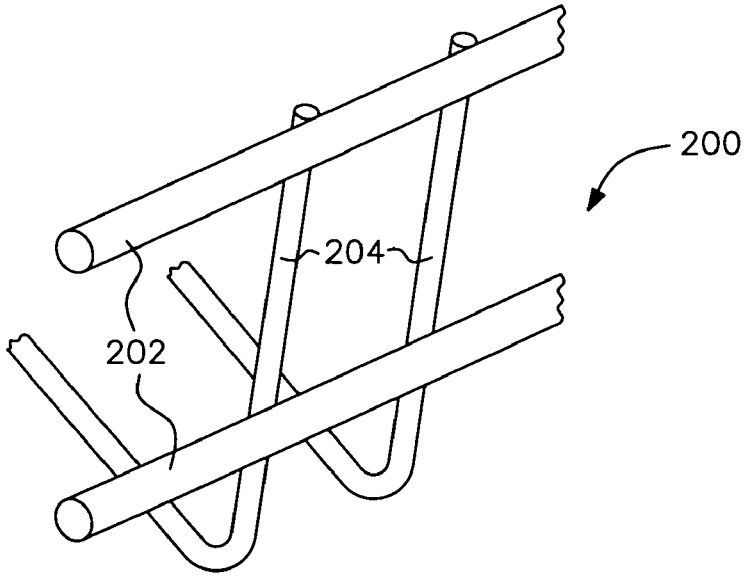
FIG. 2 (PRIOR ART)
FIG. 2 is a perspective view of a wire basket or rack used for merchandise display purposes as is well known in the art.
Figure 3:
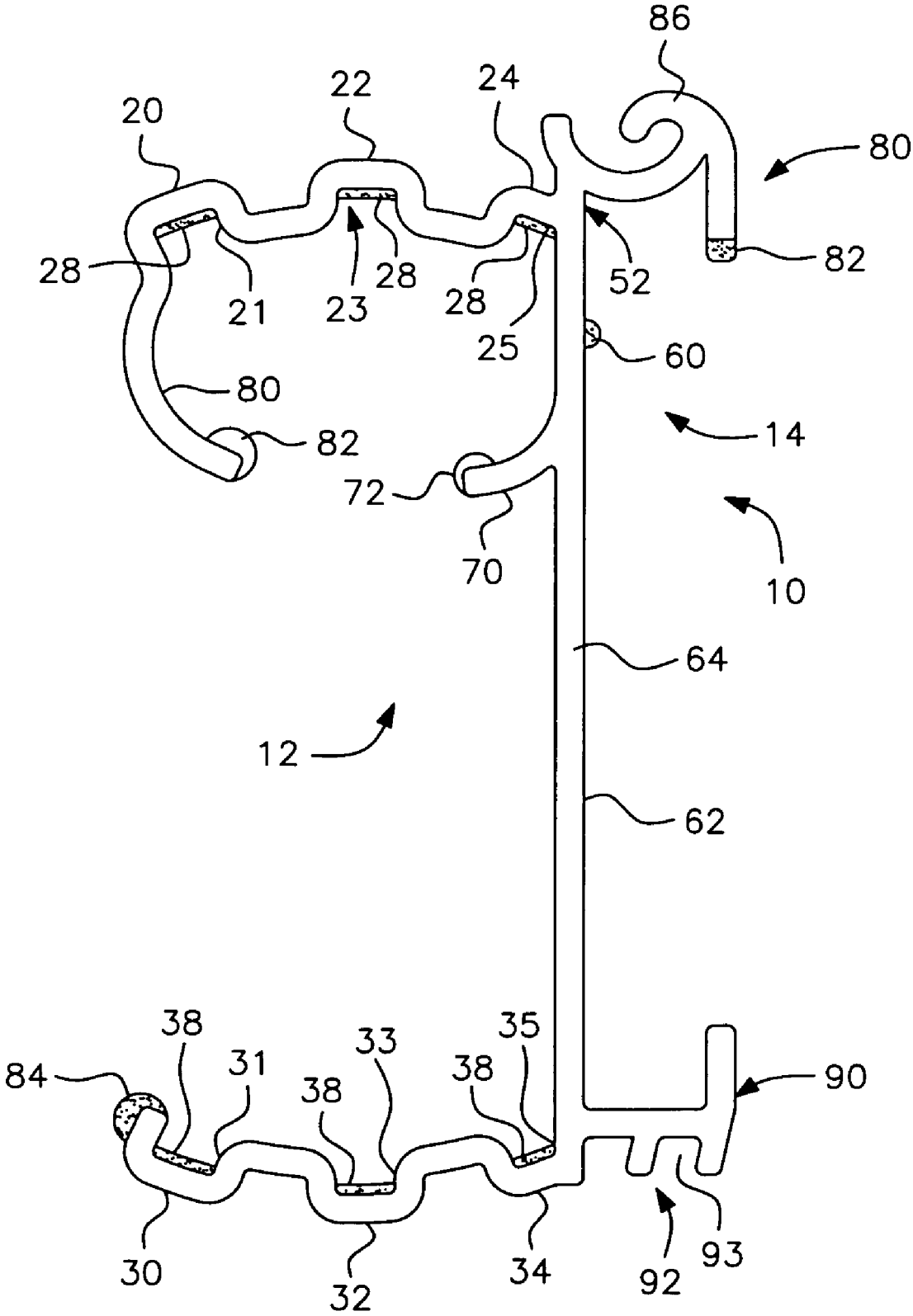
FIG. 3 is a cross-sectional or side view of the novel label holder of the present invention.

Referring now to the drawings, the novel ESL holder 10 is depicted in side profile or cross-sectional view in FIG. 3. This label holder is mountable to scanner plate assemblies 100 of the type shown in FIG. 1 and wire supports 200, such as wire baskets, of the type as shown in FIG. 2. In FIG. 1, a scanner plate 102 is of generally rectangular or square shape which traditionally would form a support surface for a label or a label holder. The scanner plate 102 is secured to the distal end of an upper hook 104 at a right angle bend thereof. The upper hook 104 is disposed upwardly from a lower hook 106 which would receive the merchandise or blister packs as is well known in the art. Each of these hooks 104, 106 are supported from a proximal mounting portion, such as a pegboard 108.

Figure 5:
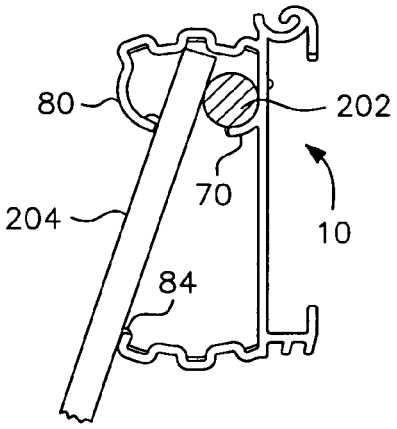
FIG. 5 is a cross-sectional or end view of the label holder of FIG. 3 mountable to a wire basket.

The wire merchandise support 200, such as a wire rack or basket, includes generally horizontally-oriented wire rods 202 and vertically-oriented wire rods 204. The vertically-oriented rods 204 may be angled forwardly as is shown in FIG. 5, to be described.

The ESL holder 10 of FIG. 3 includes a mounting portion 12 for mounting to a scanner plate or wire support, and a holder portion 14 for holding the ESL. The holder portion 14 may be one of several different types of arrangements, only one of which is shown. The holder portion 14 shown in FIG. 3 is of the type described in commonly assigned, co-pending application Ser. No. 60/616,845 filed Oct. 8, 2004, and non-provisional patent application Ser. No. 11/245,441 filed Oct. 7, 2005, incorporated by reference herein. As is described, a small rib or bead 60 of flexible polymer, such as polyvinyl chloride (PVC), is shown at 60 and can be provided on the inside surface 62 of a rear wall 64 of the holder 10 to interact with the rear surface of an ESL device (not shown) and will assist in preventing the ESL device from sliding horizontally (into or out of the page) within the holder. The rib 60 coacts with an upper finger 80 which includes a flexible lip portion 82 oriented downwardly. The lip portion 82 is of relatively soft PVC that is flexible, compressible, and generally of the same material as the rib or bead 60. The flexible bead 60 is oriented at a 90 degree angle with respect to the flexible lip 82 to assist in providing a secure attachment of the ESL. The flexible lip 82 is readily angularly distortable and makes insertion of the ESL relatively easy. However, when the ESL is positioned therewithin, the compressive force is high, thus making accidental removal relatively difficult.

The overall ESL holder 10 is preferably formed of a relatively rigid PVC plastic material and is sufficiently robust to receive and carry an ESL device (not shown). ESL devices generally will have protruding portions defining slots at their upper and lower portions thereof. Accordingly, the holder portion 14 includes complementary fingers 80, 90 or the like which, together with the rear wall 64, will secure the ESL device to the holder 10.

The ESL holder portion 14 also includes a means for retaining a cover member (not shown) thereto, as is known in the art. The cover member is secured to the holder through the C-shaped element 86 at the upper end of the holder; the lower end 92 of the holder portion 14 includes a detent 93 to receive a cover member hook.

It is the mounting portion 12 of the ESL holder that is novel to this invention. The mounting portion 12 includes an upper series of ridges 20, 22, 24 extending rearwardly from, and integral with, the top region 52 of the rear wall 64. A lower series of ridges 30, 32, 34 extends rearwardly from the bottom region 54 of the rear wall 64. At least three upper grooves 21, 23, 25 are defined by the upper ridges and include soft or flexible PVC pads 28 coextruded within each groove. Similarly, at least three bottom grooves 31, 33, 35 are defined by the lower ridges and have integrally formed flexible PVC pads 38 coextruded within the grooves. The most rearwardly set of grooves 21, 31 are generally aligned vertically as are the middle set 23, 33 and forwardly oriented grooves 25, 35.

Extending arcuately from the rear wall 64 is an arcuate finger 70 with a flexible PVC bead or ridge 72 at its free end. A similarly shaped arcuate finger 80 extends from the region adjacent the ridge 20 and also includes a flexible PVC edge 82 coextruded therewith. The free ends of each of these fingers 70, 80 face each other as is shown in FIG. 3. The free end adjacent the bottom ridge 30 includes a flexible bead 84 also coextruded of PVC.

The length and height of the ESL holder or carrier may vary within the scope of the present invention. For most applications, the length of the ESL, i.e., into the page as shown in FIG. 3, will generally be of a size to be supported on a typical scanner plate 101 as shown in FIG. 1. The ESL holder 10 can be longer than the length of the scanner plate shown in FIG. 1, but not appreciably, so as to enable a firm support for the holder 10.

Figure 4A:
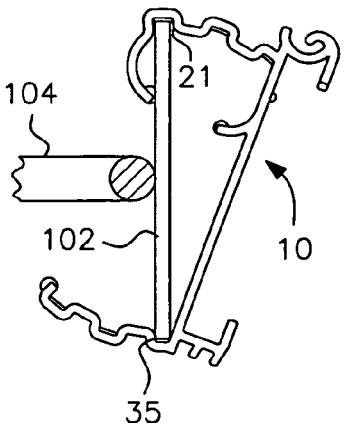
FIGS. 4(*a*), 4(*b*) and 4(*c*) depict the label holder of FIG. 3 mountable to the scanner plate in a downward, neutral and upward direction, respectively.
Figure 4B:
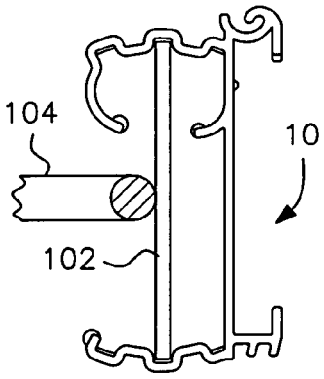
Figure 4C:
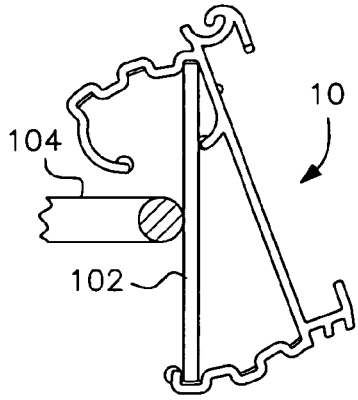

FIG. 4 shows the ESL holder 10 of the present invention mounted to the scanner plate 102 in each of three different orientations. As shown in FIG. 4(*a*), the ESL holder 10 is oriented so that the upper edge of the scanner plate lies in the rearwardmost slot or groove 21 of the upper ridge support and the bottom edge of the scanner plate lies in the groove 35 adjacent the back wall 64. As can be seen, this orients the ESL holder 10 in a downward direction. The flexible PVC pads within the grooves provide for a taut mounting. The grooves are dimensioned such that, with the flexible pads coextruded therewithin, their width is less than or just equal to the scanner plate thickness to enable the holder to be firmly mounted. In FIG. 4(*b*), the upper and lower edges of the scanner plate are disposed within the intermediate or middle slots or grooves 23, 33 of the upper and lower ridge members, respectively. Finally, in FIG. 4(*c*), the scanner plate upper and lower edges are mounted so as to orient the ESL holder in an upward direction. Thus, the ESL holder can be mounted to a scanner plate in three different orientations depending upon the height that the scanner plate is located with respect to the viewing consumer.

Figure 6:
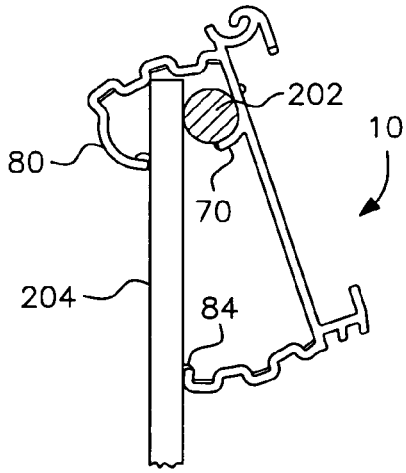
FIG. 6 is a cross-sectional or end view of the label holder of FIG. 3 mountable to a wire basket.

FIGS. 5 and 6 show the ESL holder 10 of FIG. 3 mountable to a wire merchandise support, such as a wire basket. As can be seen, the arcuate forward finger 70 tightly receives the wire 202 and the bottom flexible bead 84 rests against the vertical wire rod 204 to provide an angular support. The arcuate finger 80 is slightly compressed against the rods 204 to provide a spring-like force. That is, the arcuate finger 80 and the bottom series of ridges, through the bead 84 is stressed to provide a tight spring-like grip against the rods 204. Note that the ESL holder 10 is oriented with respect to the vertical 204 and horizontal rods 202 in only a single orientation. In FIG. 5, however, the vertical rod is angled forwardly which provides for a neutral orientation of the holder.

The foregoing descriptions and drawings should be considered as illustrative only of the principles of the invention. As noted, the invention may be configured in a variety of shapes and sizes and is not limited by the dimensions of the preferred embodiment. Other similar modifications to the disclosed embodiments can also be made within scope of the instant inventive concepts. Thus, the foregoing descriptions and drawings should be considered as illustrative only of the principles of the invention.

What is claimed is:

1. An electronic shelf label ("ESL") holder for mounting to at least one of a scanner plate and wire merchandise support, said ESL holder comprising:

an ESL holding portion for removably receiving and holding an ESL, said holding portion having an upper edge region and a lower edge region;

a mounting portion comprising an upper mounting surface extending from said upper edge region, a lower mounting surface extending from said lower edge region, each of said upper and lower mounting surfaces extending in a direction away from said holding portion, said upper mounting surface having a plurality of upper grooves, said lower mounting surface having a plurality of lower grooves, said upper grooves aligned with said lower grooves, each of said grooves including flexible pads.

2. The ESL holder of claim 1 wherein said ESL holder is formed from extruded plastic and said flexible pads are coextruded within said grooves.

3. The ESL holder of claim 2 further comprising a pair of arcuate fingers facing said upper mounting surface.

4. The ESL holder of claim 3 wherein the free ends of each arcuate finger face each other and include flexible beads of coextruded plastic.

5. The ESL holder of claim 1 wherein said grooves are dimensioned to tightly engage a scanner plate to which the ESL holder is mounted.

6. An electronic shelf label ("ESL") holder for mounting to at least one of a scanner plate and wire merchandise support, said ESL holder comprising:

an ESL holding portion for removably receiving and holding an ESL, said holding portion including a support wall having opposed front and rear wall surfaces, said front wall surface including a pair of ESL gripping fingers connected therewith for removably retaining an ESL, said support wall defining an upper edge region and a lower edge region;

a mounting portion comprising an upper mounting surface extending from said rear wall surface at said upper edge region, a lower mounting surface extending from said rear wall surface at said lower edge region, said upper mounting surface having three upper grooves, said lower mounting surface having three lower grooves, said upper grooves vertically aligned with said lower grooves.

7. The ESL holder of claim 6 wherein each of said upper and lower grooves include flexible pads.

8. The ESL holder of claim 7 wherein said ESL holder is formed from extruded plastic and said flexible pads are coextruded within said grooves.

9. The ESL holder of claim 6, wherein said three upper grooves include a first upper groove adjacent said rear wall surface, a second upper groove adjacent a free end of said upper mounting surface, and a third upper groove intermediate the first and second upper grooves.

10. The ESL holder of claim 9 wherein said three lower grooves include first, second, and third lower grooves vertically aligned with said first, second, and third upper grooves.

11. The ESL holder of claim 10 wherein the distance between the first upper groove and second lower groove, the distance between the second upper groove and first lower groove, and the distance between the second upper groove and second lower groove are all substantially equal to each other.

* * * * *